US006277244B1

(12) United States Patent
Meschenmoser

(10) Patent No.: US 6,277,244 B1
(45) Date of Patent: Aug. 21, 2001

(54) MACHINE FOR MANUFACTURING A MATERIAL WEB

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/387,515

(22) Filed: Sep. 1, 1999

(30) Foreign Application Priority Data

Sep. 2, 1998 (DE) ..... 198 40 021

(51) Int. Cl.[7] ..... D21F 1/36; D21F 2/00

(52) U.S. Cl. ..... 162/193; 162/195; 162/255; 162/286; 162/310

(58) Field of Search ..... 162/193, 194, 162/195, 252, 255, 286, 306, 308, 310

(56) References Cited

U.S. PATENT DOCUMENTS 2,709,398 5/1955 Beachler ..... 162/370
2,714,342 8/1955 Beachler ..... 162/370
2,857,822 * 10/1958 Heys ..... 162/306
5,507,916 * 4/1996 Schiel ..... 162/195
5,908,534 * 6/1999 Larsson et al. ..... 162/286

FOREIGN PATENT DOCUMENTS 2704169 8/1977 (DE) .

* cited by examiner

*Primary Examiner*—Karen M. Hastings
(74) *Attorney, Agent, or Firm*—Greenblum & Bernstein, P.L.C.

(57) ABSTRACT

A machine for producing a material web, in particular a paper or cardboard web, includes a pick-up suction roll disposed between a wire section and a press section and wound around by an air-permeable endless belt. In the vicinity of the pick-up suction roll, the material web is taken from a wire belt by the endless belt in order to then be supplied to a first press of the press section. In this regard, the width of the material web can be adjusted by adjustable size cutting elements provided in the vicinity of the wire belt and the suction width of the pick-up suction roll 14 can be adjusted by adjustable sizing strips associated therewith. An adjustment system is provided for a preferably simultaneous, at least essentially synchronous motor-induced adjustment of the size cutting elements and sizing strips.

6 Claims, 5 Drawing Sheets

MACHINE FOR MANUFACTURING A MATERIAL WEB

CROSS-REFERENCE TO RELATED APPLICATIONS

The present application claims priority under 35 U.S.C. §119 of German Patent Application No. 198 40 021.7, filed on Sep. 2, 1998, the disclosure of which is expressly incorporated by reference herein in its entirety.

BACKGROUND OF THE INVENTION

1. Field of the Invention

The invention relates to a machine for manufacturing a material web, in particular a paper or cardboard web, having a pick-up suction roll that is disposed between a wire section and a press section and is wound around by an air-permeable endless belt. In the vicinity of the pick-up suction roll, the material web is taken from a wire belt by the endless belt in order to then be supplied to a first press of the press section.

2. Discussion of Background Information

In paper machines that have been conventional up to now, a paper web having a width that changes can, as a rule, only be transferred into the press section in an open fashion, i.e., without a pick-up suction roll. It is in fact conceivable to first adjust the receiving zone of the pick-up suction roll and then to manually adjust the relevant edge-side cutting elements in order to establish the desired web width. However, this is relatively costly and cannot be carried out with the required precision in every case.

The object of the present invention is to produce an improved machine of the type mentioned at the beginning, which permits different web widths to be adjusted in as trouble-free, precise, and reproducible a manner as possible, particularly even with a closed web transfer into the press section.

SUMMARY OF THE INVENTION

The above-noted object is attained according to the present invention in that the width of the material web can be adjusted by means of adjustable size cutting elements provided in the vicinity of the wire belt, and the suction width of the pick-up suction roll can be adjusted by adjustable sizing strips associated with it. Moreover, an adjusting system is are provided for a preferably simultaneous, and at least essentially synchronous, motor-induced adjustment of the size cutting elements and the sizing strips. In this regard, the adjustable size cutting elements can be constituted in particular by adjustable sizing spray nozzles.

Because of the present invention, it is now possible to execute a respective change in the web width, particularly even when there is a closed web transfer into the press section. A respective width change is now possible in an extremely simple manner and with a high degree of precision. There is also the assurance that the respective adjustments can be reproduced at any time.

The adjusting system preferably include a control device which can be used to preset the respective size widths or associated reference positions of the size cutting elements and sizing strips. Suitable different size widths or reference positions can be programmed and/or stored by the control device.

In one embodiment of the machine according to the present invention, the adjusting device include adjusting drives that act on the size cutting elements and sizing strips and preferably include at least one path measuring system.

Suitably, at least one adjusting drive is constituted by a spindle drive. Such a spindle drive can, for example, include at least one adjusting motor provided on a spindle.

In principle, a cylinder/piston unit or the like can also be provided, for example, as an adjusting drive. Different adjusting drives can also be used, at least in part, for the different elements to be driven.

In a preferred embodiment of the machine according to the present invention, the adjusting drives and, if necessary, the path measuring system as well, are connected to the control device.

In order to produce a transfer strip that is made of the material web and in order to widen out the material web, another laterally adjustable cutting element or the like can be provided, for example, once again constituted by a spray nozzle, such that the adjusting drive associated with this additional cutting element is preferably also connected to the control device.

It is advantageous if, for the transferal of the transfer strip into the press section, the size cutting elements and the sizing strips are first adjusted according to a presettable maximal size width, to which end, for example, the control device can be correspondingly adjusted or programmed. As a result, the transfer strip can be guided through the machine in a better fashion.

It is also advantageous if, after the transferal of the transfer strip into the press section, the size cutting elements and the sizing strips are moved into their reference position corresponding to the respectively desired size width. The control device can again be correspondingly adjusted or programmed for this as well. Preferably, the size cutting elements and the sizing strips can be moved into their reference positions corresponding to the respectively desired size width the moment the material web has widened out.

The control device can, in particular, include an electronic control unit. At least part of the adjusting drives can also be remote-controlled.

According to one aspect of the present invention, a machine is provided for producing a material web, in particular a paper or cardboard web, having a pick-up suction roll disposed between a wire section and a press section and wound around by an air-permeable endless belt, and in the vicinity of the pick-up suction roll, the material web is taken from a wire belt by the endless belt in order to then be supplied to a first press of the press section. The machine includes adjustable size cutting elements that adjust the width of the material web, the adjustable cutting elements provided adjacent the wire belt, adjustable sizing strips that adjust the suction width of the pick-up suction roll, the adjustable sizing strips operatively associated with the suction roll, and an adjusting system that provides simultaneous, at least essentially synchronous motor-induced adjustment of the size cutting elements and the sizing strips.

In other aspects of the machine according to the present invention, the adjustable size cutting elements include adjustable sizing spray nozzles, the adjusting system includes a control device that predetermines at least one of respective size widths and associated reference positions of the size cutting elements and the sizing strips, and at least one of different size widths and reference positions can be at least one of programmed and stored by the control device. The adjusting system may also include at least one adjusting drive that acts on the size cutting elements and the sizing strips, the adjusting system may also include at least one path measuring system, and the at least one adjusting drive may be a spindle drive. Additionally, the spindle drive may include at least one adjusting motor provided on the spindle, the at least one adjusting drive may be a cylinder/piston unit, and at least one of the adjusting drives and a path measuring system may be connected to the control device.

In another aspect of the present invention, the machine may further include an additional laterally adjustable cutting element to produce a transfer strip made of the material web and to widen out the material web, and an additional adjusting drive associated with the additional cutting element. The additional adjusting drive may also be connected to the control device, and the additional adjustable cutting element may include a spray nozzle.

In a further aspect of the present invention, the size cutting elements and the sizing strips may be initially adjusted to a predetermined maximal size width for the transferal of the transfer strip into the press section. In this regard, the size cutting elements and the sizing strips may be movable into respective reference positions that correspond to a respectively desired web size width, after the transfer strip has been transferred into the press section, and the size cutting elements and the sizing strips may be movable into respective reference positions that correspond to the respectively desired size web width once the material web has widened out.

In another aspect of the present invention, the control device may include an electronic control unit. Additionally, the at least one adjusting drive may be remote-controlled.

According to a further aspect of the present invention, a process is provided for producing a material web, particular a paper or cardboard web, in a machine having a pick-up suction roll disposed between a wire section and a press section and wound around by an air-permeable endless belt, and in the vicinity of the pick-up suction roll, where the material web is taken from a wire belt by the endless belt in order to then be supplied to a first press of the press section. The process includes adjusting the width of the material web with adjustable size cutting elements provided adjacent the wire belt, adjusting the suction width of the pick-up suction roll with adjustable sizing strips operatively associated with the suction roll, and simultaneously adjusting the size cutting elements and the sizing strips with an adjusting system.

In other aspects of the process of the present invention, the adjusting system may include at least an essentially synchronous motor, and the adjustable size cutting elements may include adjustable sizing spray nozzles. Furthermore, the process may also include predetermining at least one of respective size widths and associated reference positions of the size cutting elements and the sizing strips by a control device operatively connected to the adjusting system. The process for producing a material web may further include programming and storing at least one of different size widths and reference positions by the control device.

In other aspects of the process of the present invention, the adjusting system may include at least one adjusting drive that acts on the size cutting elements and the sizing strips. Additionally, the adjusting system may further include at least one path measuring system, the at least one adjusting drive may be a spindle drive, and the spindle drive may include at least one adjusting motor provided on the spindle.

Additionally, other aspects of the process of the present invention include connecting at least one of the adjusting drives and a path measuring system to the control device, producing a transfer strip made of the material web and widening out the material web by providing an additional laterally adjustable cutting element and an additional adjusting drive associated with the additional cutting element, and connecting the additional laterally adjustable cutting element and the additional adjusting drive to the control device.

In another aspect of the process of the present invention, the additional adjustable cutting element may include a spray nozzle. The process may further include initially adjusting the size cutting elements and the sizing strips to a predetermined maximal size width for the transferal of the transfer strip into the press section, moving the size cutting elements and the sizing strips into respective reference positions that correspond to a respectively desired web size width, after the transfer strip has been transferred into the press section, and wherein the size cutting elements and the sizing strips are movable into respective reference positions that correspond to the respectively desired size web width once the material web has widened out.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
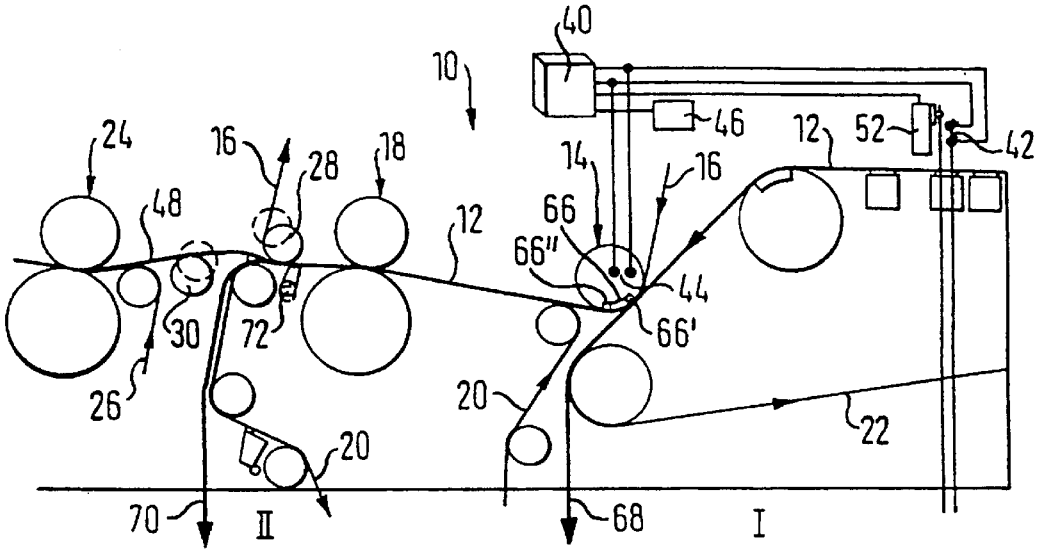
FIG. 1 is a schematic representation of a machine for producing a material web as the transfer strip is being transferred into the press section.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIGS. 1 to 6 show a machine 10 for manufacturing a material web 12 which, in the current instance, is a paper or cardboard web.

The machine 10 includes a pick-up suction roll 14 disposed between a wire section I and a press section II. This pick-up suction roll 14 is wound around by an air-permeable endless belt, in the current instance the top felt 16 of a first press 18 of the press section II, through which a bottom felt 20 is also guided. In the vicinity of the pick-up suction roll 14, the material web 12 is taken from a wire belt 22 by the top felt 16 in order to then be supplied between the two wires 12 and 20 to the first press 18 of the press section II. As can be seen from FIGS. 1, 3, and 5, the press section II includes another press 24 through which the material web 12 is guided after the first press 18, together with at least one other felt 26.

After the first press 18, in the vicinity of an adjustable deflection roll 28, the top felt 16 of this press is separated from the material web 12 and the bottom felt 20. After a separation from both the top felt 16 and the bottom felt 20, the material web 12 is guided into the other press 24 by way of a likewise adjustable support roll 30.

Figure 2:
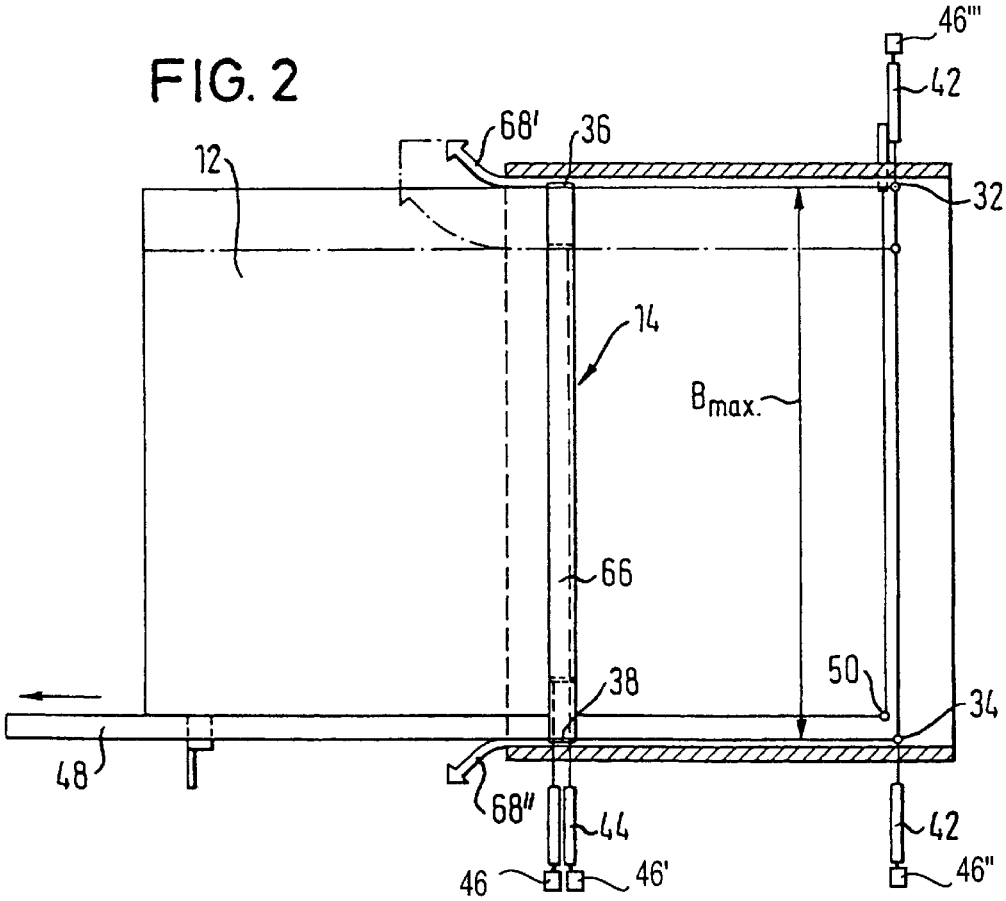
FIG. 2 is a schematic top view of the material web conveyed through the machine as the transfer strip is being transferred into the press section, where the sizing spray nozzles and sizing strips are also depicted.
Figure 4:
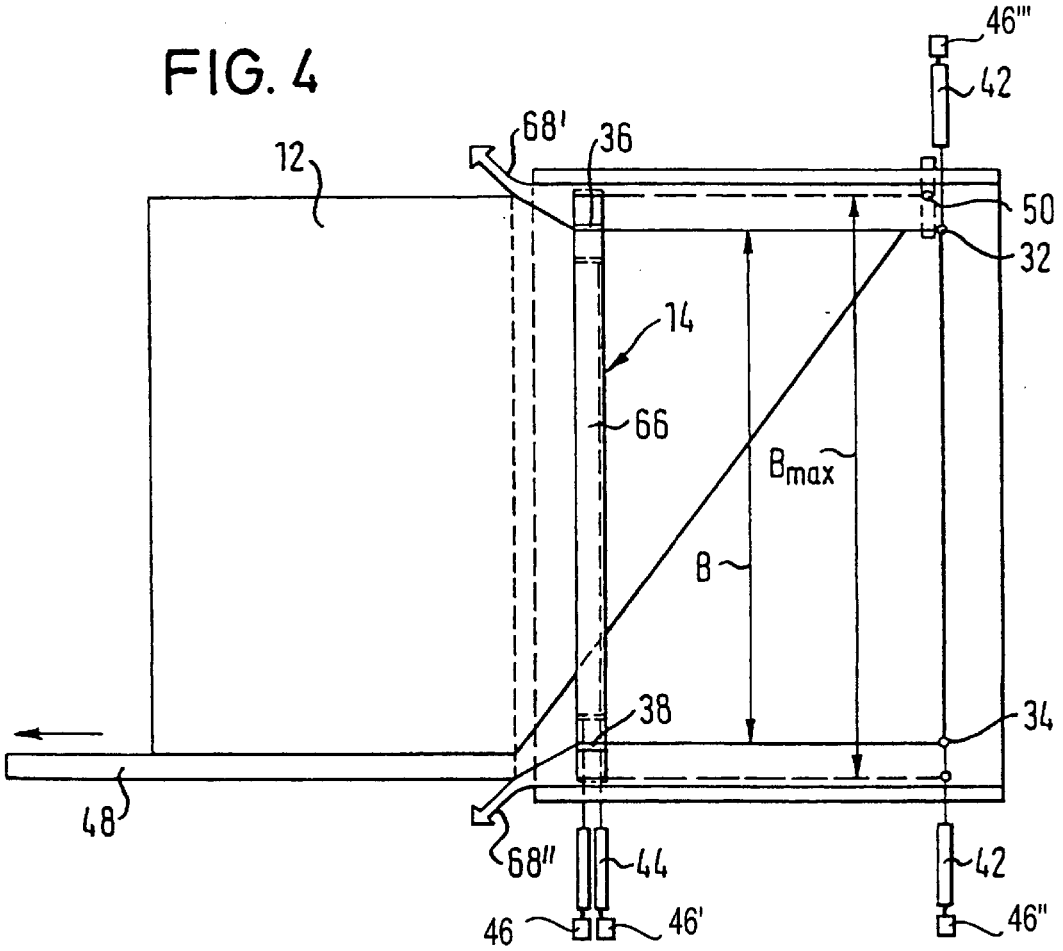
FIG. 4 is a schematic top view of the material web that is being conveyed through the machine as it widens out, where the correspondingly adjusted sizing spray nozzles and sizing strips are also depicted.
Figure 6:
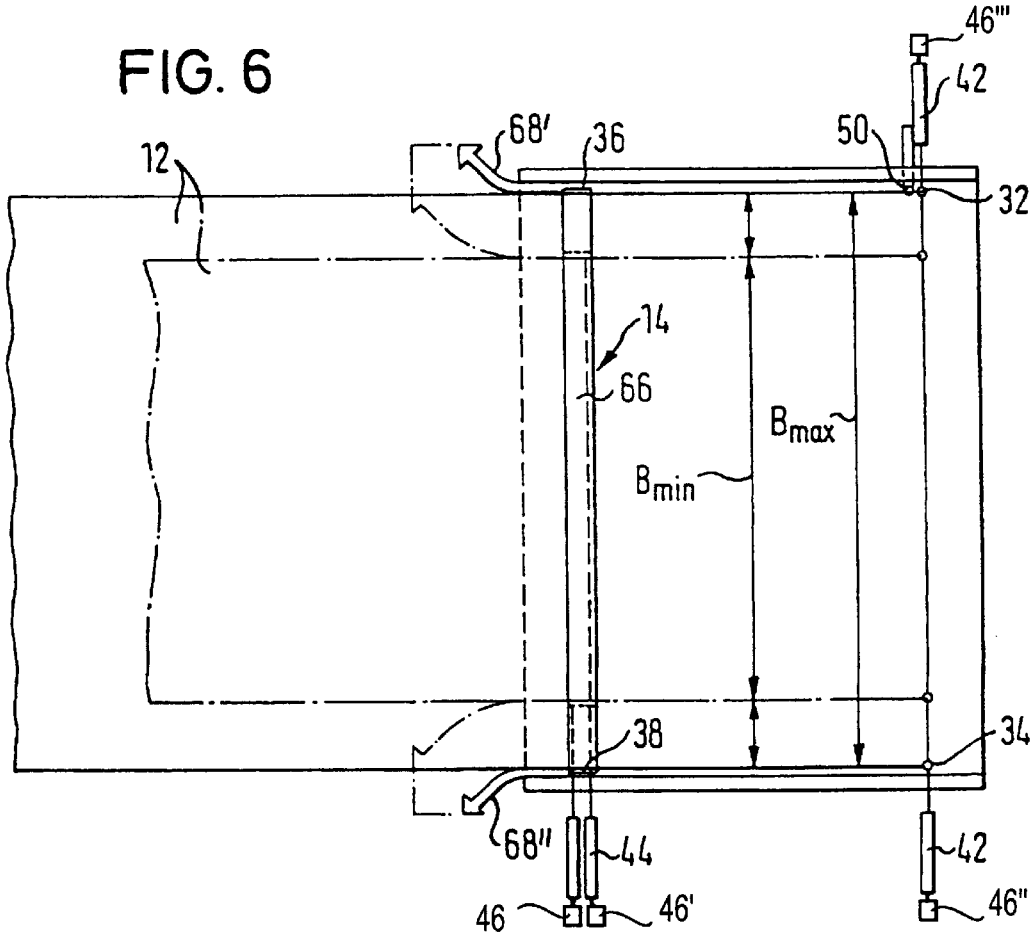
FIG. 6 is a schematic top view of the material web being conveyed through the machine after the completed transferal of the material web into the press section, where the sizing spray nozzles and sizing strips are also depicted once again.

The width B of the material web 12 can be adjusted between a minimal value $B_{min}$ and a maximal value $B_{max}$ (see also FIGS. 2, 4, and 6 in particular). To this end, two laterally adjustable sizing spray nozzles 32, 34 on the edge side, which respectively serve as size cutting elements are provided above the wire belt 22 (see FIGS. 2, 4, and 6 in particular).

Furthermore, the suction width of the pick-up suction roll 14 that is defined between two sizing strips 36, 38 can also be adjusted, for which purpose the two sizing strips 36, 38 that are associated with the pick-up suction roll 14 can be correspondingly adjusted in the lateral direction.

Finally, the machine 10 also includes a system 40, 42, 44 for a simultaneous, at least essentially synchronous, motor-induced adjustment of the sizing spray nozzles 32, 34 and sizing strips 36, 38. As can be seen from FIGS. 2, 4, and 6, in the current instance, the sizing spray nozzles 32, 34 and sizing strips 36, 38 are continuously adjusted so that the suction width of the pick-up suction role 14 is at least essentially the same as the web width B that is adjusted by the sizing spray nozzles 32, 34.

The adjusting system 40, 42, 44 includes a control device 40, which can be used to preset the respective size widths or associated reference positions of the sizing spray nozzles 32, 34 and sizing strips 36, 38. In particular, different size widths or reference positions can also be programmed and/or stored by the control device 40.

Figure 3:
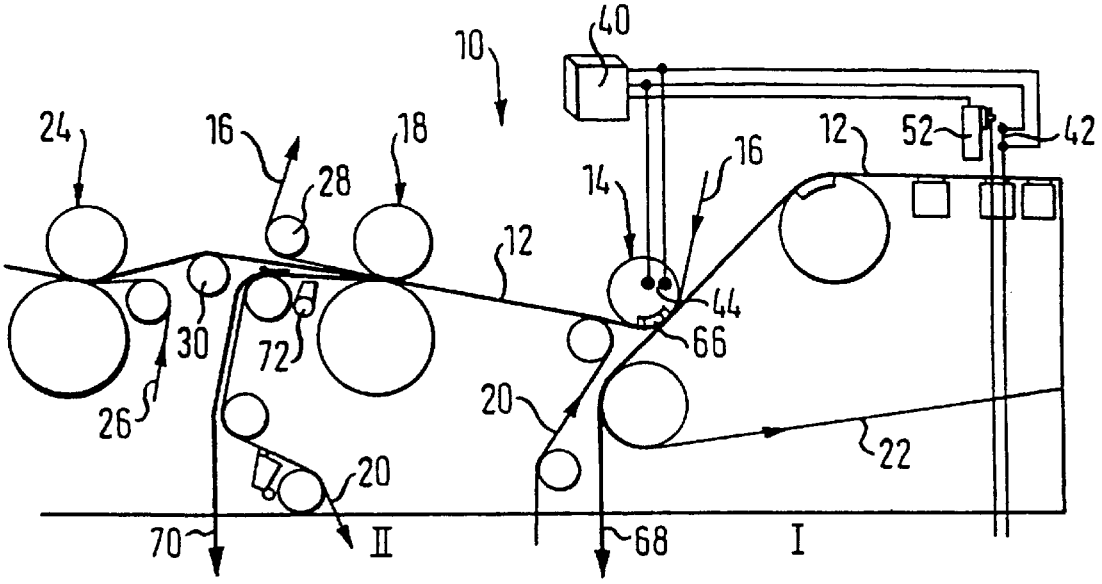
FIG. 3 is a schematic representation of the machine as the material web is widening out.
Figure 5:
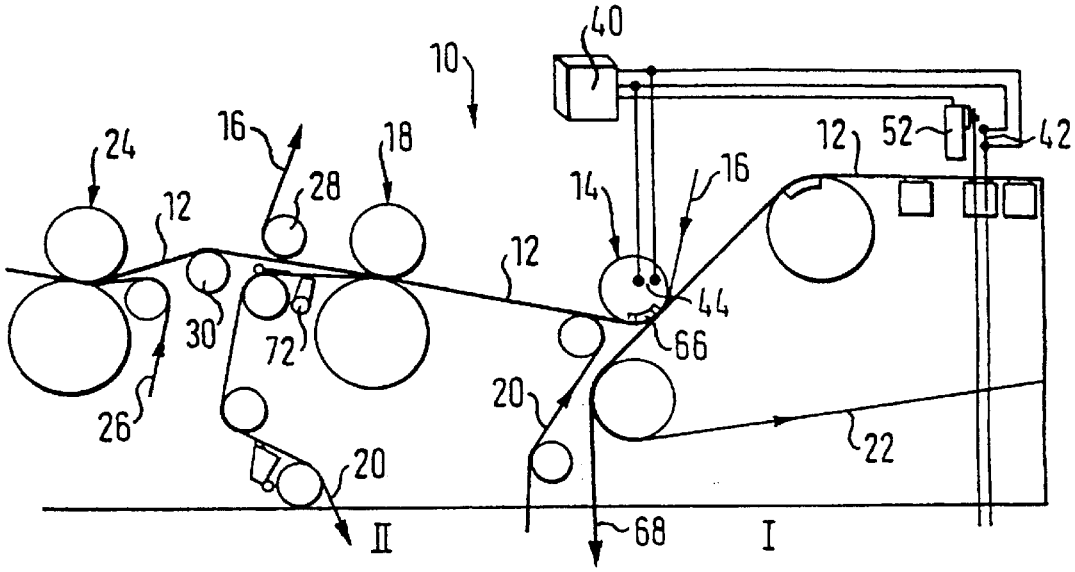
FIG. 5 is a schematic representation of the machine after the completed transferal of the material web into the press section.

The adjusting system 40, 42, 44 additionally includes adjusting drives 42 and 44, which are connected to the control device 40 and act on the sizing spray nozzles 32, 34 and sizing strips 36, 38; these adjusting drives are only indicated in a purely schematic form in FIGS. 1, 3, and 5. Finally, the control device 40 can also be connected to at least one path measuring system 46, 46', 46", 46'" (see FIGS. 1 and 2), whose measurement values can be transmitted to the control device 40 for the monitoring of relevant adjusting movements. For example, a spindle drive, a cylinder/piston unit, and/or the like can be provided as the adjusting drive 42, 44. A respective spindle drive can, for example, include at least one adjusting motor provided on a spindle. The measuring system 46–46'" can measure rotations of the shafts of the spindle drives, and can be selected to measure any desired parameter.

In order to produce a transfer strip 48, which is made of the material web 12, as well as for the widening out of the material web 12, an additional spray nozzle 50 is provided, which once again serves as a cutting element and can also be adjusted in the lateral direction. The adjusting drive 52 that is associated with this additional spray nozzle 50 is also connected to the control device 40.

The control device 40 can particularly include an electronic control unit. At least part of the adjusting drives 42, 44, and 52 can be remote-controlled.

Figure 7:
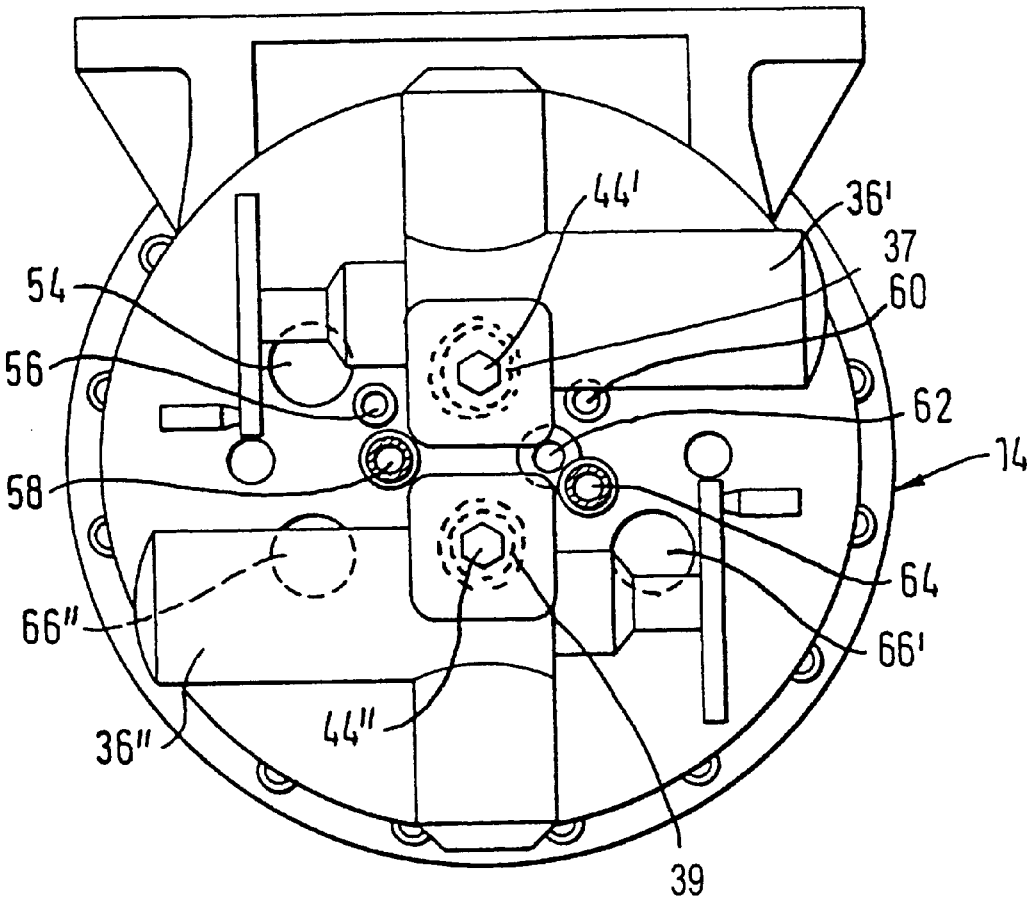
FIG. 7 is a purely schematic, partially sectional representation of an exemplary embodiment of a pick-up suction roll.
Figure 8:
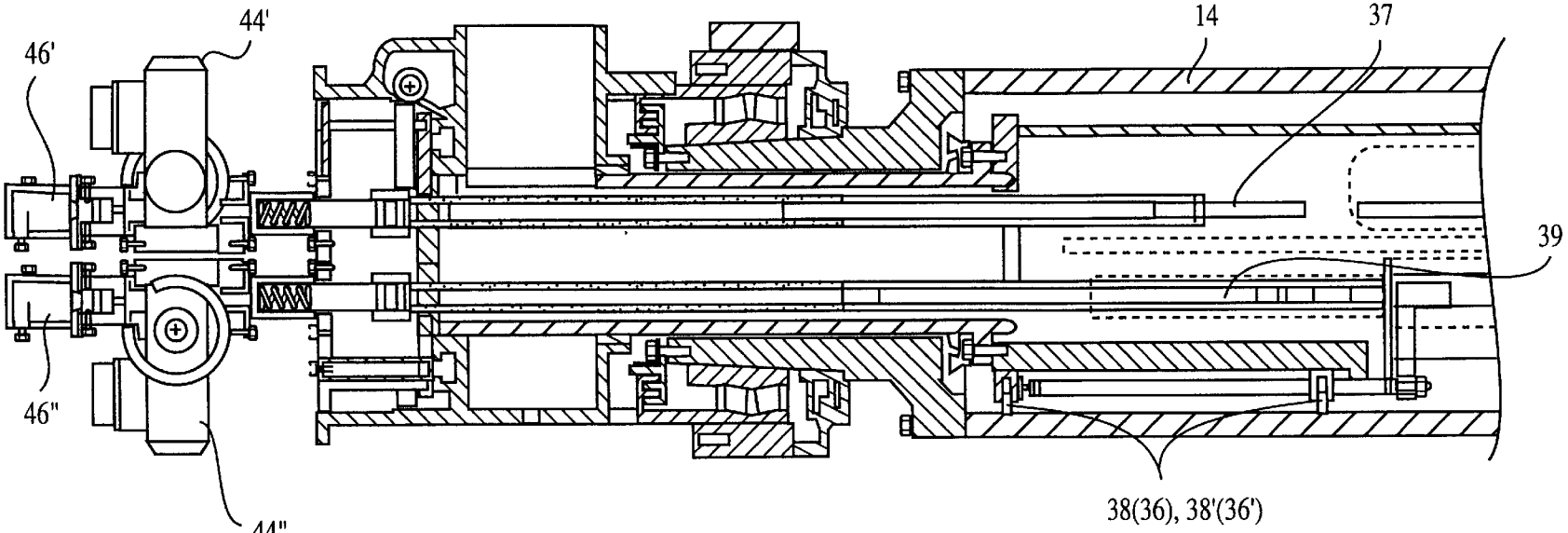
FIG. 8 is a partial longitudinal cross-sectional view of the pickup suction roll of FIG. 7.
Figure 9:
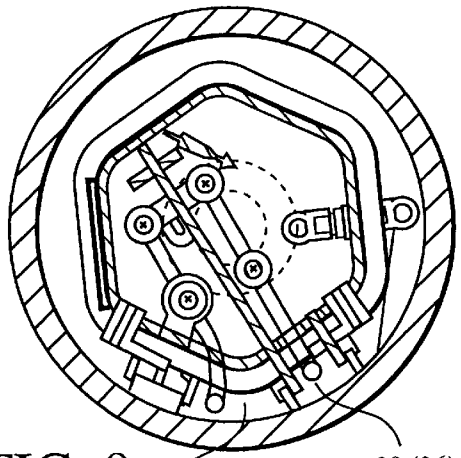
FIG. 9 is a transverse cross-sectional view of the pick-up suction roll of FIG. 8 showing the sizing strips.

In a purely schematic, partially sectional representation, FIG. 7 shows an exemplary embodiment of a pick-up suction roll 14. The partial longitudinal cross-sectional view of the pick-up suction roll 14 of FIG. 8 illustrates the spindles 37 and 39 that are driven by respective spindle drives 44', 44", and the sizing strips 38, 38' for one side are shown in FIGS. 8 and 9. In FIG. 7, two sizing strips 36', 36" can be seen, which can each be acted on by a spindle drive 44', 44". Also according to FIG. 7, the pick-up suction roll 14 particularly includes an air pressure suction zone seal 54, a suction zone seal 56, a strip wash 58, a support bearing lubrication 60, a shock pulse measuring device 62, and a strip lubrication 64. As can be inferred in particular from FIG. 1, the suction region 66 of the pick-up suction roll 14 is divided into a pick-up zone 66' and a holding zone 66". FIG. 7 shows the relevant vacuum lines for these two zones 66', 66".

As can be inferred from FIGS. 1 and 2, for the transferal of the transfer strip 48 into the press section II, the sizing spray nozzles 32, 34 and the sizing strips 36, 38 are first adjusted according to a maximal size width $B_{max}$ which can be predetermined. In addition, the two rolls 28, 30 are moved downward when the transfer strip 48 is transferred. The wet broke picked up by the wire belt 22 is conveyed downward in same manner as the press broke 70 that is picked up by the bottom wire 20 (see FIG. 1). As can be seen from FIG. 2, the width of the edge strip wet broke 68' and 68" changes with the adjustment of the sizing spray nozzles 32, 34 and the sizing strips 36, 38.

As can be inferred from FIGS. 3 and 4, the sizing spray nozzles 32, 34 and the sizing strips 36, 38 are moved into their reference positions that correspond to the respectively desired size width B after the transfer strip 48 has been transferred into the press section II. In this connection, the sizing spray nozzles 32, 34 and the sizing strips 36, 38 are moved into their reference positions that correspond to the desired size width B the moment the material web 12 has widened out, which can be seen in FIG. 4. The widening out of the material web 12 takes place by a corresponding movement of the other injection nozzle 50 in the lateral direction. According to FIG. 3, the two rolls 28 and 30 are now moved upward so that the bottom felt 20 is separated from the material web 12 closer to the first press 18. To this end, a blower device 72 can be provided inside the loop of the bottom felt 20 and, like the two rolls 28, 30, can be moved in the manner indicated in FIG. 1. The wet broke 68 and the press broke 70 are conveyed downward once more.

Whereas in FIGS. 3 and 4, the machine 10 is depicted still during the widening out of material web 12, the machine 10 in FIGS. 5 and 6 is shown after the material web 12 has been completely transferred into the press section II. The wet broke 68, which is picked up by the wire belt 22, is conveyed further downward. In the current operating phase, though, there is no longer a press broke 70, as was still the case during the widening out of the material web 12. The deflection role 28 and the support role 30 as well as the blower device 72 assume their upper position.

As mentioned above, the web width can be adjusted between a minimal value $B_{min}$ and a maximal value $B_{max}$ (see FIG. 6 in particular), for which purpose the sizing spray nozzles 32, 34 and sizing strips 36, 38 can be adjusted correspondingly in a motor-induced fashion simultaneously as well as at least synchronously by the control device 40 and the adjusting drives 42, 44.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A machine for producing a material web having a pick-up suction roll disposed between a wire section and a press section and wound around by an air-permeable endless belt, and in the vicinity of the pick-up suction roll, the material web is taken from a wire belt by the endless belt in order to then be supplied to a first press of the press section, said machine comprising:

adjustable size cutting elements that adjust the width of the material web, said adjustable cutting elements provided adjacent the wire belt;

adjustable sizing strips that provide an adjustable suction width of the pick-up suction roll, said adjustable sizing strips operatively associated with said suction roll;

an adjusting system that provides simultaneous adjustment of said size cutting elements and said sizing strips;

an additional laterally adjustable cutting element to produce a transfer strip made of the material web and to widen out the material web; and an adjusting drive associated with said additional cutting element, wherein said adjusting system includes a control device that predetermines at least one of respective size widths and associated reference positions of said size cutting elements and said sizing strips, and wherein said adjusting drive is also connected to the control device.

2. The machine according to claim 1, wherein said size cutting elements and said sizing strips are initially adjusted to a predetermined maximal size width for the transferal of the transfer strip into the press section.

3. The machine according to claim 2, wherein said size cutting elements and said sizing strips are movable into respective reference positions that correspond to a respectively desired web size width, after the transfer strip has been transferred into the press section.

4. A process for producing a material web in a machine having a pick-up suction roll disposed between a wire section and a press section and wound around by an air-permeable endless belt, and in the vicinity of the pick-up suction roll, where the material web is taken from a wire belt by the endless belt in order to then be supplied to a first press of the press section, said process comprising:

adjusting the width of the material web with adjustable size cutting elements provided adjacent the wire belt;

adjusting the suction width of the pick-up suction roll with adjustable sizing strips operatively associated with said suction roll;

simultaneously adjusting said size cutting elements and said sizing strips with an adjusting system;

predetermining at least one of respective size widths and associated reference positions of said size cutting elements and said sizing strips by a control device operatively connected to said adjusting system;

producing a transfer strip made of the material web and widening out the material web by providing an additional laterally adjustable cutting element and an adjusting drive associated with said additional cutting element; and connecting said additional laterally adjustable cutting element and said adjusting drive to the control device.

5. The process for producing a material web according to claim 4, further comprising initially adjusting said size cutting elements and said sizing strips to a predetermined maximal size width for the transferal of the transfer strip into the press section.

6. The process for producing a material web according to claim 5, further comprising moving said size cutting elements and said sizing strips into respective reference positions that correspond to a respectively desired web size width, after the transfer strip has been transferred into the press section.

* * * * *